US009824524B2

(12) United States Patent
Comeau et al.

(10) Patent No.: US 9,824,524 B2
(45) Date of Patent: Nov. 21, 2017

(54) THREE DIMENSIONAL ENHANCEMENTS TO GAME COMPONENTS IN GAMING SYSTEMS

(71) Applicant: IGT Canada Solutions ULC, Moncton (CA)

(72) Inventors: Brian Comeau, Memramcook (CA); Bethany Trainor, Dieppe (CA); Francois Romeo Leger, Dieppe (CA)

(73) Assignee: IGT CANADA SOLUTIONS ULC, Moncton (CA)

( * ) Notice: Subject to any disclaimer, the term of this patent is extended or adjusted under 35 U.S.C. 154(b) by 47 days.

(21) Appl. No.: 14/291,662

(22) Filed: May 30, 2014

(65) Prior Publication Data

US 2015/0348359 A1 Dec. 3, 2015

(51) Int. Cl.
*G07F 17/32* (2006.01)
*G07F 17/34* (2006.01)

(52) U.S. Cl.
CPC ..... *G07F 17/3213* (2013.01); *G07F 17/34* (2013.01)

(58) Field of Classification Search
CPC ..... G07F 17/3213; G07F 17/3211
See application file for complete search history.

(56) References Cited

U.S. PATENT DOCUMENTS 5,152,529 A * 10/1992 Okada ..... G07F 17/3213 273/143 R
6,607,441 B1 8/2003 Acres
6,846,238 B2 1/2005 Wells
7,727,069 B1 * 6/2010 Nelson ..... G07F 17/32 463/20
7,804,995 B2 9/2010 Lipton et al.
8,366,538 B1 2/2013 Saunders et al.
(Continued)

FOREIGN PATENT DOCUMENTS

CA 2601560 A1 10/2006
CA 2783122 A1 1/2013
(Continued)

OTHER PUBLICATIONS

United States Patent and Trademark Office, Office Action dated Jun. 20, 2014, issued on U.S. Appl. No. 13/631,129.
(Continued)

*Primary Examiner* — Jay Liddle
*Assistant Examiner* — Alex F. R. P. Rada, II
(74) *Attorney, Agent, or Firm* — Sage Patent Group

(57) ABSTRACT

An electronic gaming machine, an electronic gaming system, and a computer-implemented method are disclosed. The electronic gaming machine comprises: at least one processor; at least one persistent data store; at least one receiver to receive game data for storage in the at least one persistent data store; and a display device configured with a user interface to display a portion of the game data as a first matrix of at least one of a row and a column of game components in accordance with a set of game rules for a given game, each one of the game components having an original symbol associated thereto, and at least a second matrix of at least one of a row and a column of game components in accordance with the set of game rules for the given game, each game components having an original symbol associated thereto.

20 Claims, 11 Drawing Sheets

(56) References Cited

U.S. PATENT DOCUMENTS 8,371,930 B1 2/2013 Saunders et al.
8,414,380 B2 * 4/2013 Saunders ..... G07F 17/32 463/11
8,715,060 B2 5/2014 Bowron
2002/0122585 A1 9/2002 Swift et al.
2003/0032479 A1 2/2003 LeMay et al.
2003/0064805 A1 4/2003 Wells
2004/0012145 A1 * 1/2004 Inoue ..... G07F 17/3213 273/143 R
2004/0017041 A1 * 1/2004 Inoue ..... G07F 17/3213 273/143 R
2004/0026854 A1 * 2/2004 Inoue ..... G07F 17/3213 273/143 R
2004/0036218 A1 * 2/2004 Inoue ..... G07F 17/34 273/292
2004/0038726 A1 * 2/2004 Inoue ..... G07F 17/3213 463/20
2004/0041340 A1 * 3/2004 Inoue ..... G07F 17/34 273/143 R
2004/0218269 A1 11/2004 Divelbiss et al.
2005/0020278 A1 1/2005 Krumm et al.
2005/0117637 A1 6/2005 Routhier et al.
2005/0190180 A1 9/2005 Jin et al.
2005/0277460 A1 * 12/2005 Inoue ..... G07F 17/3213 463/20
2006/0287060 A1 12/2006 Yoshimi
2007/0296859 A1 12/2007 Suzuki
2008/0020845 A1 1/2008 Low et al.
2008/0113746 A1 * 5/2008 Williams ..... G07F 17/3211 463/20
2008/0113775 A1 * 5/2008 Williams ..... G07F 17/3202 463/25
2008/0318684 A1 12/2008 Rofougaran
2009/0036208 A1 * 2/2009 Pennington ..... G07F 17/3202 463/33
2010/0267439 A1 10/2010 Englman et al.
2010/0298040 A1 11/2010 Joshi et al.
2011/0032329 A1 2/2011 Bauza et al.
2011/0045891 A1 2/2011 Ansari
2011/0298795 A1 12/2011 Van Der Heijden et al.
2012/0077564 A1 3/2012 Collette et al.
2012/0122547 A1 5/2012 Aoki et al.
2012/0165101 A1 6/2012 Krishnamoorthy et al.
2013/0019024 A1 1/2013 Sheth et al.
2013/0093752 A1 4/2013 Yuan
2013/0178271 A1 7/2013 Aponte et al.
2013/0184070 A1 7/2013 Gadher et al.
2013/0184071 A1 7/2013 Gadher et al.
2014/0094268 A1 4/2014 Adams
2014/0187309 A1 7/2014 Trainor et al.
2014/0194183 A1 7/2014 Pierer et al.
2015/0248809 A1 * 9/2015 Dupuis ..... G07F 17/3211 463/20

FOREIGN PATENT DOCUMENTS

CA 2783272 A1 1/2013
CA 2800295 A1 3/2014
CA 2827465 A1 3/2014
EP 2551832 A2 1/2013
WO 2008118800 A1 10/2008

OTHER PUBLICATIONS

United States Patent and Trademark Office, Office Action dated Aug. 25, 2014, issued on U.S. Appl. No. 13/631,129.
Patent Cooperation Treaty, Written Opinion and International Search Report dated Oct. 30, 2013, issued on PCT Application No. PCT/CA2013/000636.

* cited by examiner

THREE DIMENSIONAL ENHANCEMENTS TO GAME COMPONENTS IN GAMING SYSTEMS

TECHNICAL FIELD

Embodiments described herein relate to the field of electronic gaming systems, such as on-line gaming and gaming systems in casinos.

BACKGROUND OF THE INVENTION

Various video gaming systems or machines are known. These may consist of slot machines, online gaming systems (that enable users to play games using computer devices, whether desktop computers, laptops, tablet computers or smart phones), computer programs for use on a computer device (including desktop computer, laptops, tablet computers of smart phones), or gaming consoles that are connectable to a display such as a television or computer screen.

Video gaming machines may be configured to enable users to play a variety of different types of games. One type of game displays a plurality of moving arrangements of gaming elements (such as reels, and symbols on reels), and one or more winning combinations are displayed using a pattern of gaming elements in an arrangement of cells (or an "array"), where each cell may include a gaming element, and where gaming elements may define winning combinations (or a "winning outcome" or "winning pattern").

Games that are based on winning patterns may be referred to as "pattern games" in this disclosure.

One example of a pattern game is a game that includes spinning reels, where a user wagers on one or more lines, activates the game, and the spinning reels are stopped to show one or more patterns in an array. The game rules may define one or more winning patterns of gaming elements, and these winning patterns may be associated with credits, points or the equivalent.

Gaming systems or machines of this type are popular, however, there is a need to compete for the attention of users, and therefore it is necessary to innovate by launching new, engaging game features.

It is to be understood that gaming components and game components are interchangeable terms in this disclosure.

SUMMARY OF THE INVENTION

There are described systems, devices, and methods for providing layered enhancements to game components in a gaming system. In particular, embodiments described herein may provide an electronic gaming machine, an electronic gaming system, and computer-implemented method for enhancing game components in a gaming system using layered three-dimensional enhancements. The three-dimensional enhancements may involve a game with multiple matrices layered in a three-dimensional configuration. The game may integrate gaming components from each matrix to determine winning outcomes.

In some embodiments of the invention, an electronic gaming machine (EGM) for providing three dimensional enhancements to game components is provided. The EGM comprises:

at least one processor;

at least one persistent data store;

at least one receiver to receive game data for storage in the at least one persistent data store; and a display device configured with a user interface to display a portion of the game data as a first matrix of at least one of a row and a column of game components in accordance with a set of game rules for a given game, each one of the game components having an original symbol associated thereto, and at least a second matrix of at least one of a row and a column of game components in accordance with the set of game rules for the given game, each game components having an original symbol associated thereto;

wherein the processor is configured to:

identify at least one game component of the first matrix as a trigger game component;

detect activation of the trigger game component;

trigger an action event associated with the second matrix;

integrate at least one game component of the second matrix into the given game; and determine a winning outcome using the first matrix and the second matrix;

wherein the first matrix is layered on top of the second matrix.

In some embodiments of the invention, the at least one game component of the second matrix lights up on the user interface when integrated into the given game.

In some embodiments of the invention, the display device is further configured to display a portion of the game data as a third matrix of at least one of a row and a column of game components in accordance with the set of game rules for the given game, each one of the game components having an original symbol associated thereto; and the processor is further configured to:

identify at least one game component of the second matrix as a second trigger game component;

detect activation of the second trigger game component;

trigger an action event associated with the third matrix;

integrate at least one game component of the third matrix into the given game; and determine a winning outcome using the first matrix, the second matrix, and the third matrix;

wherein the second matrix is layered on top of the third matrix.

According to some embodiments of the invention, the first matrix is a first reel, and wherein the second matrix is a second reel embedded within the first reel.

According to some embodiments of the invention, the third matrix is a third reel embedded within the second reel.

According to some embodiments of the invention, the first reel and the second reel are arranged asymmetrically such that the first reel and the second reel each has a different center of gravity on the user display.

According to some embodiments of the invention, one or more game components are caused by the display device to light up when a winning, a payline or a trigger is activated or triggered.

According to some embodiments of the invention, at least one wild card is transferred from one game component to another game component within the same matrix, or from a game component in a matrix to a different game component in another matrix.

According to some embodiments of the invention, all the game components in a matrix constitute a single symbol that is an expanding wild card.

According to some embodiments of the invention, the action event is a spin of the second reel.

According to some embodiments of the invention, the at least one game component of the second matrix is associated with a prize value used for the winning outcome.

According to some embodiments of the invention, the at least one game component of the second matrix triggers a progressive jackpot prize used for the winning outcome.

According to some embodiments of the invention, the at least one game component of the third matrix triggers a progressive jackpot or a bonus game prize used for the winning outcome.

According to some embodiments of the invention, the at least one game component of the second matrix triggers a secondary prize used for the winning outcome.

According to some embodiments of the invention, the trigger game component of the first matrix is a transparent game component that reveals the at least one game component of the second matrix.

According to some embodiments of the invention, the at least one game component of the second matrix is associated with at least one additional symbol used for the winning outcome by forming a winning outcome with a symbol of the at least one gaming component of the first matrix.

According to some embodiments of the invention, the display device is configured with the user interface to display at least one stack of game components, wherein the at least one stack of game components comprises the trigger game component from the first matrix and the at least one game component from the second matrix.

According to some embodiments of the invention, the display device is configured with the user interface to display the first matrix and the second matrix in a three-dimensional layered configuration.

According to some embodiments of the invention, the display device is further configured to display the trigger game component of the first matrix as a transparent area such that the at least one additional game component of the second matrix behind and visible through the transparent area to integrate the at least one additional symbol into the given game.

According to some embodiments of the invention, the display device is further configured to display a portion of the game data as a third matrix of at least one of a row and a column of game components in accordance with the set of game rules for the given game, each one of the game components having an original symbol associated thereto; and the processor is further configured to:

identify at least one game component of the second matrix as a second trigger game component;

detect activation of the second trigger game component;

trigger an action event associated with the third matrix;

integrate at least one game component of the third matrix into the given game; and determine a winning outcome using the first matrix, the second matrix, and the third matrix;

wherein the second matrix is layered on top of the third matrix.

According to some embodiments of the invention, an electronic gaming system for providing three dimensional enhancements to game components is provided. The electronic game system comprises:

a server comprising a transmitter for transmitting electronic data signals representing game data;

an electronic device comprising:

at least one processor;

at least one persistent data store;

at least one receiver to receive the electronic data signals representing game data for storage in the at least one persistent data store;

a display device configured with a user interface to display a portion of the game data as a first matrix of at least one of a row and a column of game components in accordance with a set of game rules for a given game, each one of the game components having an original symbol associated thereto, and at least a second matrix of at least one of a row and a column of game components in accordance with the set of game rules for the given game, each game components having an original symbol associated thereto;

wherein the processor is configured to:

identify at least one game component of the first matrix as a trigger game component;

detect activation of the trigger game component;

trigger an action event associated with the second matrix;

integrate at least one game component of the second matrix into the given game; and determine a winning outcome using the first matrix and the second matrix; and a network configured to provide a communication link to couple the server and the electronic device.

According to some embodiments of the invention, the electronic device is an electronic gaming terminal and wherein the system further comprises:

a mobile gaming device operated by a player coupled via a communications link to the electronic gaming terminal, the mobile gaming device running a remote gaming program to play the given game, the electronic gaming terminal programmed to carry out at least the game functions of pseudo-randomly determining a game outcome and determining an award to a player, receiving player control signals by the first gaming terminal from the mobile gaming device to initiate the first game;

wherein the electronic gaming terminal is configured to carry out the game by the first gaming terminal, including determining a final outcome of the game and any award for the winning outcome and transmit electronic data signals to the mobile gaming device identifying the winning outcome of the game and the award.

According to some embodiments of the invention, a computer implemented method for providing three dimensional enhancements to game components is provided, the method comprising:

receiving, via at least one receiver, game data for storage in at least one persistent data store;

displaying, using a display device, a portion of the game data as a first matrix of at least one of a row and a column of game components in accordance with a set of game rules for a given game, each one of the game components having an original symbol associated thereto, and at least a second matrix of at least one of a row and a column of game components in accordance with the set of game rules for the given game, each game components having an original symbol associated thereto;

identifying, using a processor, at least one game component of the first matrix as a trigger game component;

detecting, using the processor, activation of the at least one trigger game component;

triggering, using the processor, an action event associated with the second matrix;

integrating, using the processor, at least one game component of the second matrix into the given game; and determining, using the processor, a winning outcome using the first matrix and the second matrix.

According to some embodiments of the invention, the method further comprises displaying, using a display device, the first matrix and the second matrix in a three-dimensional layered configuration.

According to some embodiments of the invention, the trigger game component of the first matrix is a transparent game component, wherein the method further comprises revealing, using the display device, the at least one game component of the second matrix through the transparent game component of the first matrix.

According to some embodiments of the invention, the method further comprises:

displaying, using a display device, the first matrix as a first reel;

displaying, using a display device, the second matrix as a second reel embedded within the first reel; and spinning, using the processor, the second reel as the action.

According to some embodiments of the invention, the method further comprises:

displaying, using the display device, a portion of the game data as a third matrix of at least one of a row and a column of game components in accordance with the set of game rules for the given game, each one of the game components having an original symbol associated thereto;

identifying, using the processor, at least one game component in the second matrix as a second trigger game component;

detecting, using the processor, activation of the second trigger game component of the second matrix;

triggering, using the processor, an action event associated with the third matrix;

integrating, using the processor, the at least one game component of the third matrix into the given game; and determining, using the processor, the winning outcome using the first matrix, the second matrix, and the third matrix.

Features of the systems, devices, and methods described herein may be used in various combinations, and may also be used for the system and computer-readable storage medium in various combinations.

In this specification, the term "game component" or game element is intended to mean any individual element which when grouped with other elements will form a layout for a game. For example, in a spinning reel game, each reel may be made up of one or more game components. Each game component may be represented by a symbol of a given image, number, shape, color, theme, etc. Like symbols are of a same image, number, shape, color, theme, etc. Other embodiments for game components will be readily understood by those skilled in the art.

BRIEF DESCRIPTION OF THE DRAWINGS

Further features and advantages of embodiments described herein may become apparent from the following detailed description, taken in combination with the appended drawings, in which.

It will be noted that throughout the appended drawings, like features are identified by like reference numerals.

DETAILED DESCRIPTION

Figure 1:
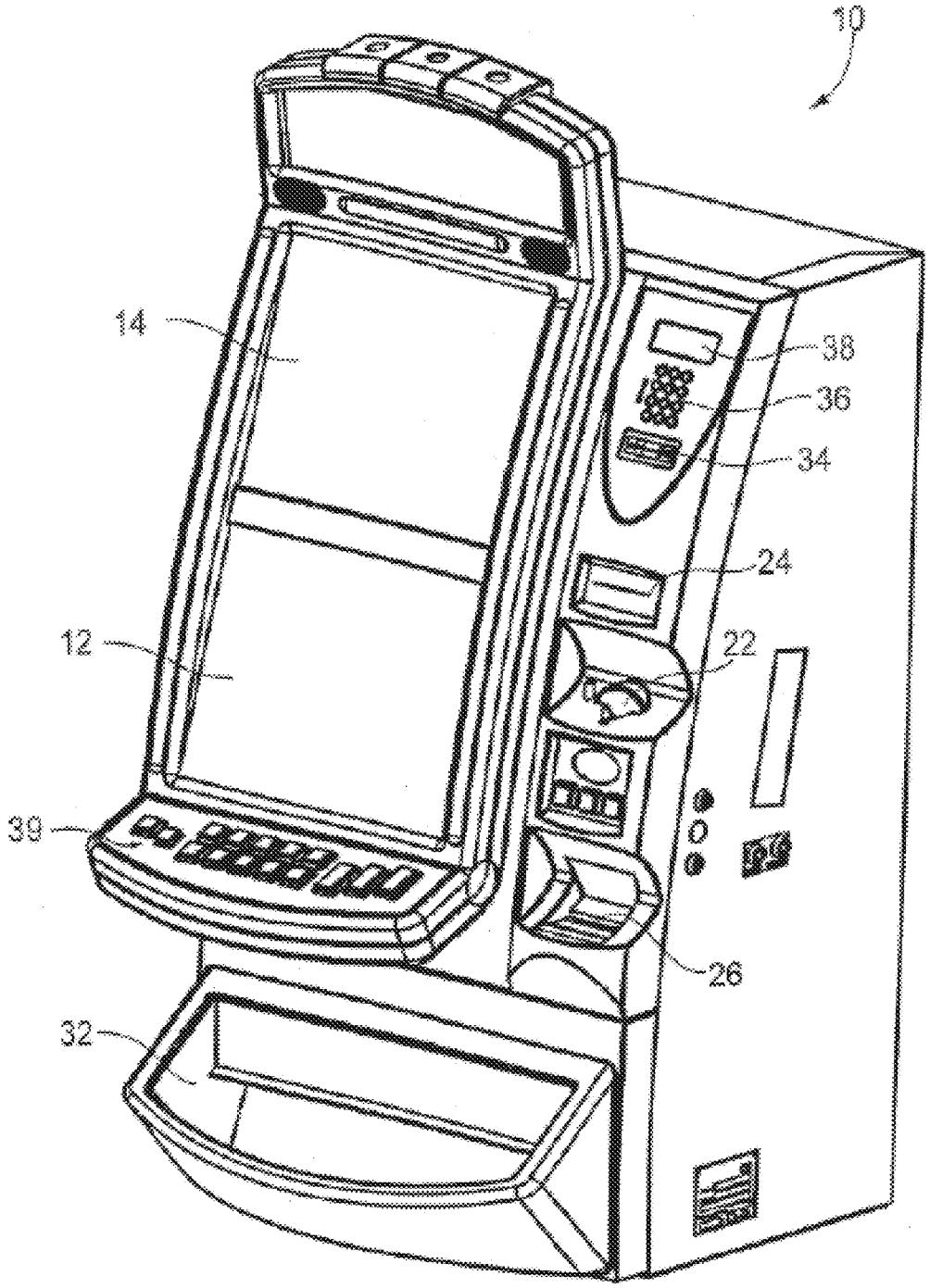
FIG. 1 is a perspective view of an electronic gaming machine for implementing the gaming enhancements, according to some embodiments.

The embodiments of the systems and methods described herein may be implemented in hardware or software, or a combination of both. These embodiments may be implemented in computer programs executing on programmable computers, each computer including at least one processor, a data storage system (including volatile memory or non-volatile memory or other data storage elements or a combination thereof), and at least one communication interface. For example, and without limitation, the various programmable computers may be a server, gaming machine, network appliance, set-top box, embedded device, computer expansion module, personal computer, laptop, personal data assistant, cellular telephone, smartphone device, UMPC tablets and wireless hypermedia device or any other computing device capable of being configured to carry out the methods described herein.

Program code is applied to input data to perform the functions described herein and to generate output information. The output information is applied to one or more output devices, in known fashion. In some embodiments, the communication interface may be a network communication interface. In embodiments in which elements of the invention are combined, the communication interface may be a software communication interface, such as those for inter-process communication. In still other embodiments, there may be a combination of communication interfaces implemented as hardware, software, and combination thereof.

Each program may be implemented in a high level procedural or object oriented programming or scripting language, or a combination thereof, to communicate with a computer system. However, alternatively the programs may be implemented in assembly or machine language, if desired. The language may be a compiled or interpreted language. Each such computer program may be stored on a storage media or a device (e.g., ROM, magnetic disk, optical disc), readable by a general or special purpose programmable computer, for configuring and operating the computer when the storage media or device is read by the computer to perform the procedures described herein. Embodiments of the system may also be considered to be implemented as a non-transitory computer-readable storage medium, configured with a computer program, where the storage medium so configured causes a computer to operate in a specific and predefined manner to perform the functions described herein.

Furthermore, the systems and methods of the described embodiments are capable of being distributed in a computer program product including a physical, non-transitory computer readable medium that bears computer usable instructions for one or more processors. The medium may be provided in various forms, including one or more diskettes, compact disks, tapes, chips, magnetic and electronic storage media, volatile memory, non-volatile memory and the like. Non-transitory computer-readable media may include all computer-readable media, with the exception being a transitory, propagating signal. The term non-transitory is not intended to exclude computer readable media such as primary memory, volatile memory, RAM and so on, where the data stored thereon may only be temporarily stored. The computer useable instructions may also be in various forms, including compiled and non-compiled code.

Throughout the following discussion, numerous references will be made regarding servers, services, interfaces, portals, platforms, or other systems formed from computing devices. It should be appreciated that the use of such terms is deemed to represent one or more computing devices having at least one processor configured to execute software instructions stored on a computer readable tangible, non-transitory medium. For example, a server can include one or more computers operating as a web server, database server, or other type of computer server in a manner to fulfill described roles, responsibilities, or functions. One should further appreciate the disclosed computer-based algorithms, processes, methods, or other types of instruction sets can be embodied as a computer program product comprising a non-transitory, tangible computer readable media storing the instructions that cause a processor to execute the disclosed steps. One should appreciate that the systems and methods described herein may transform electronic signals of various data objects into three dimensional representations for display on a tangible screen configured for three dimensional displays. One should appreciate that the systems and methods described herein involve interconnected networks of hardware devices configured to receive data using receivers, transmit data using transmitters, and transform electronic data signals for various three dimensional enhancements using particularly configured processors, where the three dimensional enhancements are for subsequent display on three dimensional adapted display screens.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The gaming enhancements described herein may be carried out using any type of computer, including portable devices, such as smart phones, that can access a gaming site or a portal (which may access a plurality of gaming sites) via the internet or other communication path (e.g., a LAN or WAN). Embodiments described herein can also be carried out using an electronic gaming machine (EGM) in various venues, such as a casino. One example type of EGM is described with respect to FIG. 1.

FIG. 1 is a perspective view of an EGM 10 where the three-dimensional enhancements to game components may be provided. EGM 10 includes a display 12 that may be a thin film transistor (TFT) display, a liquid crystal display (LCD), a cathode ray tube (CRT), auto stereoscopic three dimensional display. and LED display, an OLED display, or any other type of display. A second display 14 provides game data or other information in addition to display 12. Display 14 may provide static information, such as an advertisement for the game, the rules of the game, pay tables, pay lines, or other information, or may even display the main game or a bonus game along with display 12. Alternatively, the area for display 14 may be a display glass for conveying information about the game. Display 12/14 may also include a camera.

Display 12 or 14 may have a touch screen lamination that includes a transparent grid of conductors. Touching the screen may change the capacitance between the conductors, and thereby the X-Y location of the touch may be determined. The processor associates this X-Y location with a function to be performed. Such touch screens may be used for slot machines. There may be an upper and lower multi-touch screen in accordance with some embodiments.

A coin slot 22 may accept coins or tokens in one or more denominations to generate credits within EGM 10 for playing games. An input slot 24 for an optical reader and printer receives machine readable printed tickets and outputs printed tickets for use in cashless gaming.

A coin tray 32 may receive coins or tokens from a hopper upon a win or upon the player cashing out. However, the gaming machine 10 may be a gaming terminal that does not pay in cash but only issues a printed ticket for cashing in elsewhere. Alternatively, a stored value card may be loaded with credits based on a win, or may enable the assignment of credits to an account associated with a computer system, which may be a computer network connected computer.

A card reader slot 34 may accept various types of cards, such as smart cards, magnetic strip cards, or other types of cards conveying machine readable information. The card reader reads the inserted card for player and credit information for cashless gaming. The card reader may read a magnetic code on a conventional player tracking card, where the code uniquely identifies the player to the host system. The code is cross-referenced by the host system to any data related to the player, and such data may affect the games offered to the player by the gaming terminal. The card reader may also include an optical reader and printer for reading and printing coded barcodes and other information on a paper ticket. A card may also include credentials that enable the host system to access one or more accounts associated with a user. The account may be debited based on wagers by a user and credited based on a win. Alternatively, an electronic device may couple (wired or wireless) to the EGM 10 to transfer electronic data signals for player credits and the like. For example, near field communication (NFC) may be used to couple to EGM 10 which may be configured with NFC enabled hardware. This is a non-limiting example of a communication technique.

A keypad 36 may accept player input, such as a personal identification number (PIN) or any other player information. A display 38 above keypad 36 displays a menu for instructions and other information and provides visual feedback of the keys pressed.

The keypad 36 may be an input device such as a touch-screen, or dynamic digital button panel, in accordance with some embodiments.

Player control buttons 39 may include any buttons or other controllers needed for the play of the particular game or games offered by EGM 10 including, for example, a bet button, a repeat bet button, a spin reels (or play) button, a maximum bet button, a cash-out button, a display pay lines button, a display payout tables button, select icon buttons, and any other suitable button. Buttons 39 may be replaced by a touch screen with virtual buttons.

The EGM 10 may also include hardware configured to provide optical motion tracking. The optical motion tracking may include a body and head controller.

As described herein, EGM 10 may be configured to provide three dimensional enhancements to game components. The three dimensional enhancements may be provided dynamically as dynamic game content in response to electronic data signals relating to player input, game activity, player interactivity with display and EGM 10, and so on. the EGM 10 may include a display with multi-touch and auto stereoscopic three-dimensional functionality, including a camera, for example. The EGM 10 may also include several effects and frame lights. The three dimensional enhancements may be three dimensional variants of gaming components. For example, the three dimensional variants may not be limited to a three dimensional version of the gaming components.

The EGM 10 may include an output device such as one or more speakers. The speakers may be located in various locations on the EGM 10 such as in a lower portion or upper portion. The EGM 10 may have a chair or seat portion and the speakers may be included in the seat portion to create a surround sound effect for the player. The seat portion may allow for easy upper body and head movement during play. Functions may be controllable via an on screen game menu. The EGM 10 is configurable to provide full control over all built-in functionality (lights, frame lights, sounds, and so on).

The EGM 10 may also couple to a user's mobile device to provide a tethering gaming experience. That is, EGM 10 may be configured to establish a communications link between a mobile gaming device operated by a player and EGM 10. The mobile gaming device may run a remote gaming program to play games via EGM 10, and the EGM 10 may be programmed to carry out at game functions of pseudo-randomly determining a game outcome and determining an award to a player. The EGM 10 may receive player control signals from the mobile gaming device to initiate a game. The EGM 10 may carry out the game, including determining a final outcome of the game and any award for the outcome. The EGM 10 may transmit signals to the mobile gaming device identifying the final outcome of the first game and the award. In this configuration, a player may play games provided by the EGM 10 remotely using their mobile gaming device.

That is, a wireless hand-held device, such as a tablet, may be used to remotely play EGM 10. The EGM 10, for security and central monitoring/accounting purposes, may perform all the processing to deduct a bet from the remote player's stored bank of credits, randomly select a game outcome, determine the award to be paid to the player, and credit the player's bank of credits. The information processed by EMG 10 may be wirelessly communicated to the tablet, and the predetermined outcome may be displayed to the player (such as by displaying stopped reels). The tablet may function as a user interface and display.

The EGM 10 may also include a camera. The camera may be used for motion tracking of player, such as detecting player positions and movements, and generating signals defining x, y and z coordinates. A viewing object of the game may be illustrated as a three-dimensional enhancement coming towards the player. Another viewing object of the game may be illustrated as a three-dimensional enhancement moving away from the player. The players head position may be used as a view guide for the viewing camera during a three-dimensional enhancement. A player sitting directly in front of display 12 may see a different view than a player moving aside. The camera may also be used to detect occupancy of the machine.

The EGM 10 may also include a digital button panel. The digital button panel may include various elements such as for example, a touch display, animated buttons, frame light, and so on. The digital button panel may have different states, such as for example, standard play containing bet steps, bonus with feature layouts, point of sale, and so on. The digital button panel may include a slider bar for adjusting the three-dimensional panel. The digital button panel may include buttons for adjusting sounds and effects. The digital button panel may include buttons for betting and selecting bonus games. The digital button panel may include a game status display. The digital button panel may include animation. The buttons of the digital button panel may include a number of different states, such as pressable but not activated, pressed and active, inactive (not pressable), certain response or information animation, and so on. The EGM 10 may also include physical buttons.

The EGM 10 may include frame and effect lights. The lights may be synchronized with enhancements of the game. The EGM 10 may be configured to control color and brightness of lights. Additional custom animations (color cycle, blinking, etc.) may also be configured by the EGM 10. The customer animations may be triggered by certain gaming events.

Figure 2A:
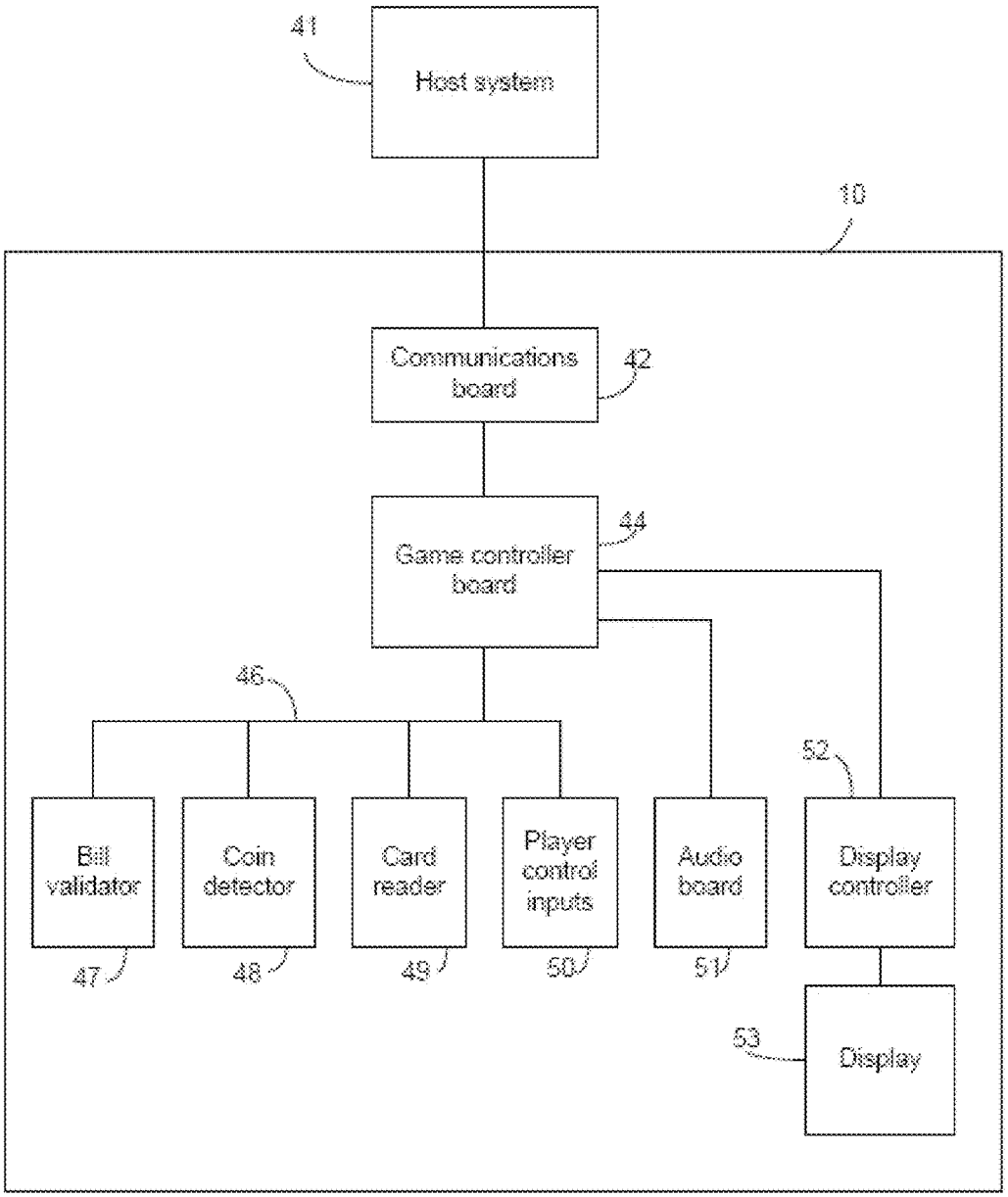
FIG. 2*a* is a block diagram of an electronic gaming machine linked to a casino host system, according to some embodiments.
Figure 2B:
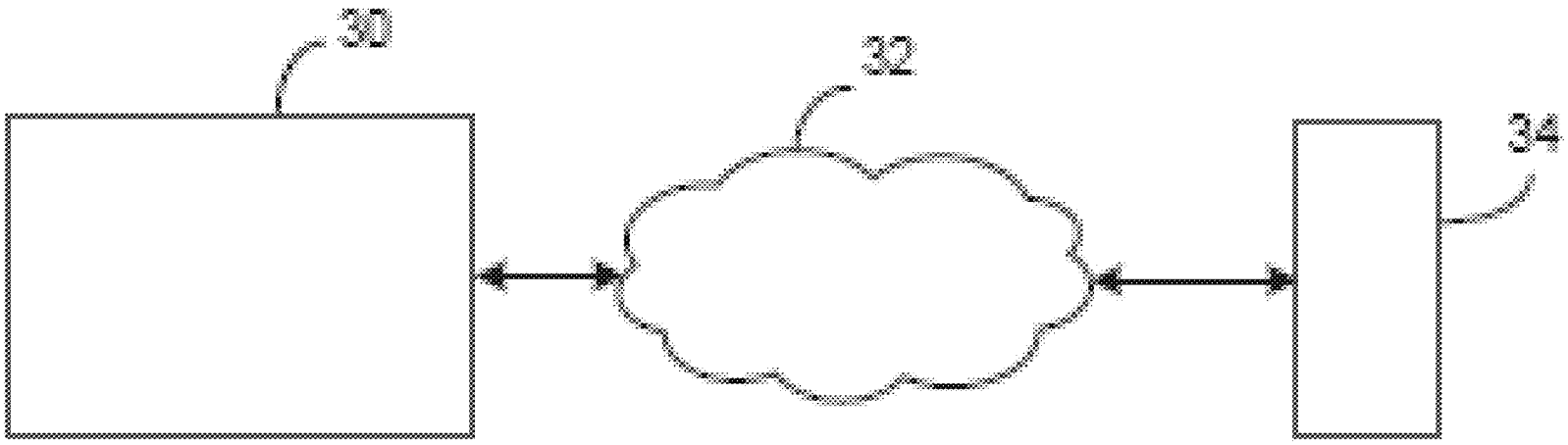
FIG. 2*b* is an exemplary online implementation of a computer system and online gaming system.

FIG. 2*a* is a block diagram of EGM 10 linked to the casino's host system 41. The EGM 10 may use conventional hardware. FIG. 2*b* illustrates a possible online implementation of a computer system and online gaming device in accordance with the present gaming enhancements. For example, a server computer 34 may be configured to enable online gaming in accordance with embodiments described herein. One or more users may use a computing device 30 that is configured to connect to the Internet 32 (or other network), and via the Internet 32 to the server computer 34 in order to access the functionality described in this disclosure.

A communications board 42 may contain conventional circuitry for coupling the EGM 10 to a local area network (LAN) or other type of network using any suitable protocol, such as the G2S protocols. Internet protocols are typically used for such communication under the G2S standard, incorporated herein by reference. The communications board 42 transmits using a wireless transmitter, or it may be directly connected to a network running throughout the casino floor. The communications board 42 basically sets up a communication link with a master controller and buffers data between the network and the game controller board 44. The communications board 42 may also communicate with a network server, such as in accordance with the G2S standard, for exchanging information to carry out embodiments described herein.

The game controller board 44 contains memory and a processor for carrying out programs stored in the memory and for providing the information requested by the network. The game controller board 44 primarily carries out the game routines.

Peripheral devices/boards communicate with the game controller board 44 via a bus 46 using, for example, an RS-232 interface. Such peripherals may include a bill validator 47, a coin detector 48, a smart card reader or other type of credit card reader 49, and player control inputs 50 (such as buttons or a touch screen).

The game controller board 44 also controls one or more devices that produce the game output including audio and video output associated with a particular game that is presented to the user. For example audio board 51 converts coded signals into analog signals for driving speakers. A display controller 52, which typically requires a high data transfer rate, converts coded signals to pixel signals for the display 53. Display controller 52 and audio board 51 may be directly connected to parallel ports on the game controller board 44. The electronics on the various boards may be combined onto a single board.

Computing device 30 may be particularly configured with hardware and software to interact with gaming machine 10 or gaming server 34 via network 32 to implement gaming functionality and render three dimensional enhancements, as described herein. For simplicity only one computing device 30 is shown but system may include one or more computing devices 30 operable by users to access remote network resources. Computing device 30 may be implemented using one or more processors and one or more data storage devices configured with database(s) or file system(s), or using multiple devices or groups of storage devices distributed over a wide geographic area and connected via a network (which may be referred to as "cloud computing").

Computing device 30 may reside on any networked computing device, such as a personal computer, workstation, server, portable computer, mobile device, personal digital assistant, laptop, tablet, smart phone, WAP phone, an interactive television, video display terminals, gaming consoles, electronic reading device, and portable electronic devices or a combination of these. As described herein, a computing device 30 may couple to EGM 10 to remotely play games via EGM 10. Further, in some configurations computing device 30 may operate as EGM 10, or components thereof.

Computing device 30 may include any type of processor, such as, for example, any type of general-purpose microprocessor or microcontroller, a digital signal processing (DSP) processor, an integrated circuit, a field programmable gate array (FPGA), a reconfigurable processor, a programmable read-only memory (PROM), or any combination thereof. Computing device 30 may include any type of computer memory that is located either internally or externally such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like.

Computing device 30 may include one or more input devices, such as a keyboard, mouse, camera, touch screen, sensors, and a microphone, and may also include one or more output devices such as a display screen (with three dimensional capabilities) and a speaker. Computing device 30 has a network interface in order to communicate with other components, to access and connect to network resources, to serve an application and other applications, and perform other computing applications by connecting to a network (or multiple networks) capable of carrying data including the Internet, Ethernet, plain old telephone service (POTS) line, public switch telephone network (PSTN), integrated services digital network (ISDN), digital subscriber line (DSL), coaxial cable, fiber optics, satellite, mobile, wireless (e.g. Wi-Fi, WiMAX), SS7 signaling network, fixed line, local area network, wide area network, and others, including any combination of these. Computing device 30 is operable to register and authenticate users (using a login, unique identifier, and password for example) prior to providing access to applications, a local network, network resources, other networks and network security devices. Computing device 30 may serve one user or multiple users.

Although not shown, computing device 30 may comprise displays 12, 14 as well to display various game components to one or more users. A computing device 30 may couple to EGM 10 to remotely play games via EGM 10. Further, in some configurations computing device 30 may operate as EGM 10, or components thereof.

Embodiments described herein may provide layered enhancements to game components in gaming systems. In an aspect, embodiments described herein may provide a layered reel type game. The reel may have depth to it in that there may be one or more layered reel segments that cooperate and integrate for the reel game.

Figure 3:
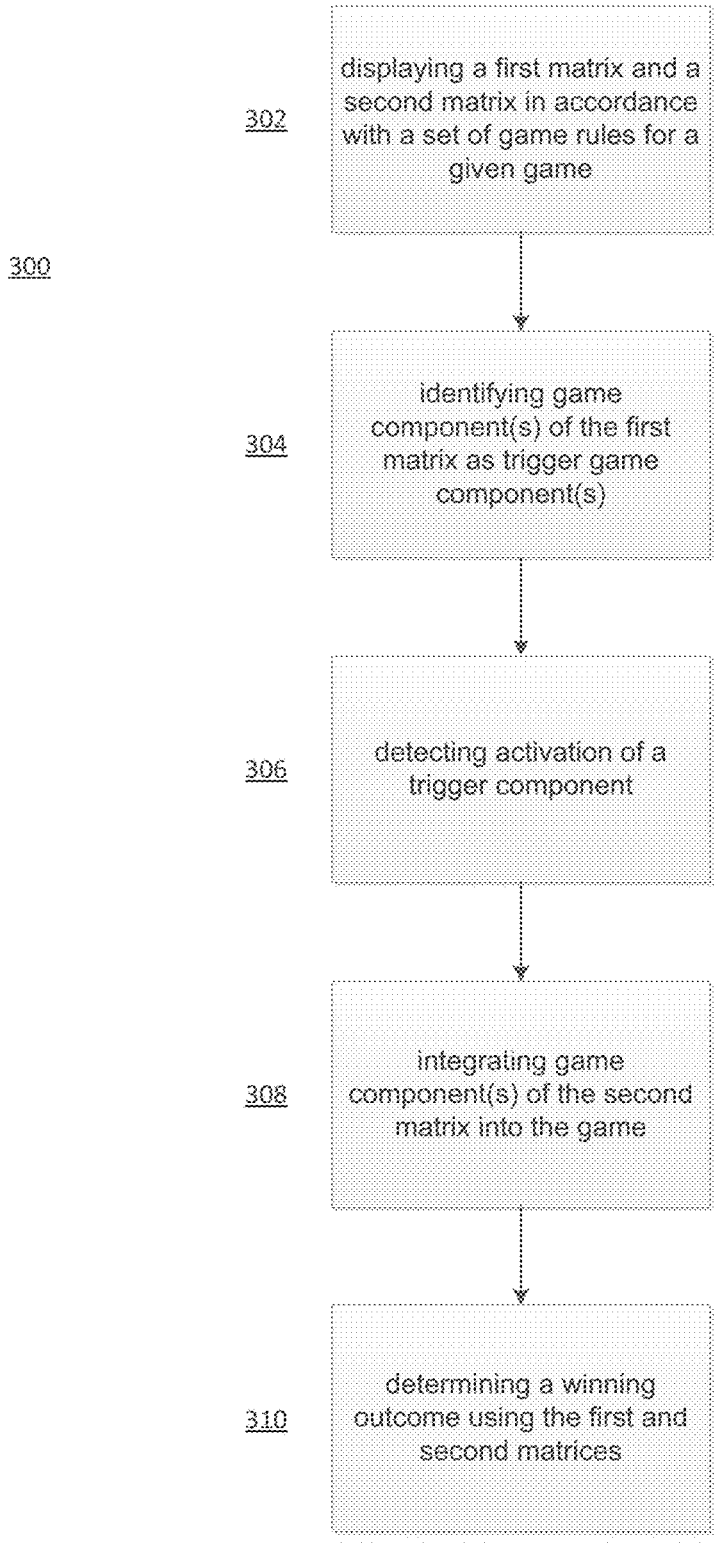
FIG. 3 is a flowchart illustrating an exemplary embodiment for a computer-implemented method for enhancing game components according to some embodiments.

FIG. 3 is a flowchart illustrating an exemplary embodiment for a computer-implemented method for enhancing game components in a gaming system such as that illustrated in FIGS. 1, 2*a*, and 2*b*.

At 302, a display device 12, 14 displays game data as a first matrix of at least one of a row and/or a column of game components in accordance with a set of game rules for a given game. The display device 12, 14 also displays a second matrix of at least one of a row and/or a column of game components in accordance with the set of game rules for the given game; each game component has an original symbol associated thereto. The row/column may be made up of one or more game components, depending on the game being played.

In some embodiments, the first matrix is layered on top of the second matrix. For example, the first matrix may be a top matrix and the second matrix may be hidden behind the first matrix. As another example, the first matrix may be a reel, and the second matrix is another reel embedded or placed within the first reel. There may be more than two layers or two reels, each corresponding to a matrix.

The display device 12, 14 may display the first and second matrices in a three-dimensional layered configuration. That is, display device 12, 14 may display a three-dimensional enhancement by expanding the first and second matrix in a third dimension. The transformation results in a different and distinctive display of electronic data signals to illustrate the first and second matrix (as well as the additional matrices, if applicable) three-dimensionally.

As an illustrative example, embodiments described herein may provide 3D enhanced gaming components that may be displayed as a set of three dimensional reels embedded within one another to create one or more layered reel segments. In this example, each reel can represent a matrix (e.g. a column or row of gaming components). Each of the layered reel segments may be associated with multiple gaming components from the different reels which may be used to calculate winning outcomes for a given game.

Figure 4:
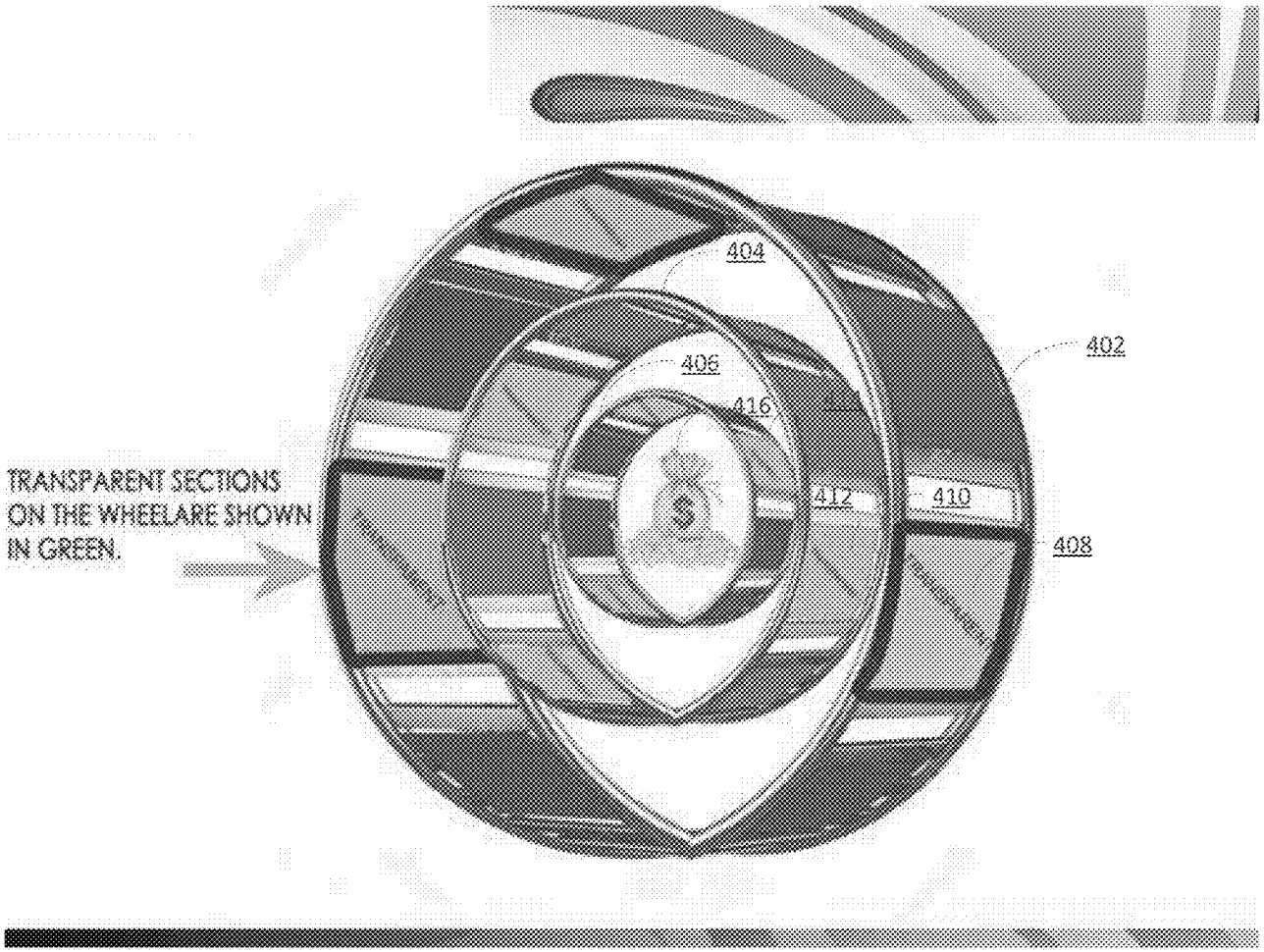
FIG. 4 is an exemplary embodiment of a layered three dimensional enhancement to a game according to some embodiments.

FIG. 4 is an exemplary embodiment of a layered three dimensional enhancement to a game. In this example, display device 12, 14 may display three reels 402, 404, 406 embedded within each other. The reels have layered segments, where a segment of one reel 402 may overlap in part or in whole with a segment of another reel 404, 406. Each layered segment can include one or more game components from each reel 402, 404, 406.

Referring back to FIG. 3, at 304, a processor (e.g. of EGM 10) identifies at least one game component of the first matrix as a trigger game component (or simply "trigger component"). The trigger component may be selected by the player, by the processor and/or by the game configuration. For example, the trigger component may be a transparent component that may reveal additional game components and symbols associated therewith.

A layered segment of the first matrix may include a trigger gaming component to trigger integration of one or more gaming components from another matrix that couples with or forms part of the layered segment. The gaming components of the layered segment may be used to determine winning outcomes, winning combinations, or for the basis of a prize award for a given game.

At 306, the processor (e.g. of EGM 10) detects activation of the trigger game component. For example, a game outcome or state may determine activation of the trigger game component. For another example, the user or gamer may have activated the trigger component by selecting one or more game components on display 12, 14.

For another example, the outer reel 402 (FIG. 4) may include a trigger gaming component. When the trigger gaming component is displayed in a stop line or otherwise landed on, it may be activated.

At 308, the processor (e.g. of EGM 10) can trigger an action event associated with the second matrix based on activation of the trigger game component, which can be related to the first matrix. For example, the action event may be a spin of the second reel. The action event may also include rotating a multi-faceted game component. The action event may involve a secondary game. Other action events may be used. As another example, the trigger game component of the first matrix may be a transparent game component that reveals a game component of the second matrix.

Based on the illustrative example of FIG. 4, when a trigger gaming component (e.g. 408, as described below) is displayed in a stop line or otherwise landed on, it may trigger the next inner reel 404 to spin. Other actions may also be triggered, such as movement of the trigger gaming component to reveal a game component of the second matrix or reel.

At 310, the processor (e.g. of EGM 10) integrates at least one game component of the second matrix into the given game. The additional game component may be integrated into the game for increased possible winning combinations, or an increased winning outcome or prize award. The game component may indicate a prize award, or an additional gaming symbol to be used to form winning combinations, for example. The next inner reel 404 may also have a trigger game component (e.g. 410), that may be integrated into the game. For example, the other trigger game component may in turn trigger the other inner reel 406 to spin, and so on. Although three reels 402, 404, 406 are shown there may be more or less reels layered to provide layered segments.

At 312, the processor (e.g. of EGM 10) can determine a winning outcome based on at least a first matrix and a second matrix. The winning outcome may be a prize associated with one or more symbols of a displayed game component (or "gaming symbols") on the second matrix. The winning outcome may be based on a winning combination of gaming symbols, including a gaming symbol of the first matrix and a gaming symbol of the second matrix, and/or multiple gaming symbols from first or second matrix. As another example, the game component or symbol of the second matrix may trigger a progressive jackpot prize used for the winning outcome. As a further example, the game component of the second matrix can trigger a secondary prize used for the winning outcome.

In some example embodiments, there may be a third matrix layered behind the second matrix, and so on. There may be even more layered matrices. The steps of FIG. 3 may apply to these additional layered matrices.

FIG. 4 is an exemplary embodiment for an enhancement to a gaming component. In this example, there is shown three reels 402, 404, 406 are embedded within each other. Each of the reels can have one or more layered segments, where a layered segment may overlap, in part or in whole, with a segment of another reel. Each layered segment includes one or more gaming components. The layered segment includes a trigger gaming component to trigger integration of one or more gaming components from another reel to form winning combinations for a given game, or for the basis of a prize award.

In one embodiment of the invention, as shown in FIG. 4, the three reels 402, 404, 406 can be positioned in such a way as to cause all three reels to have the same center of gravity (i.e., the reels are in a symmetrical arrangement), which can be positioned at the centre of the innermost reel 406 and on or around prize (or jackpot) symbol 416.

Figure 6:
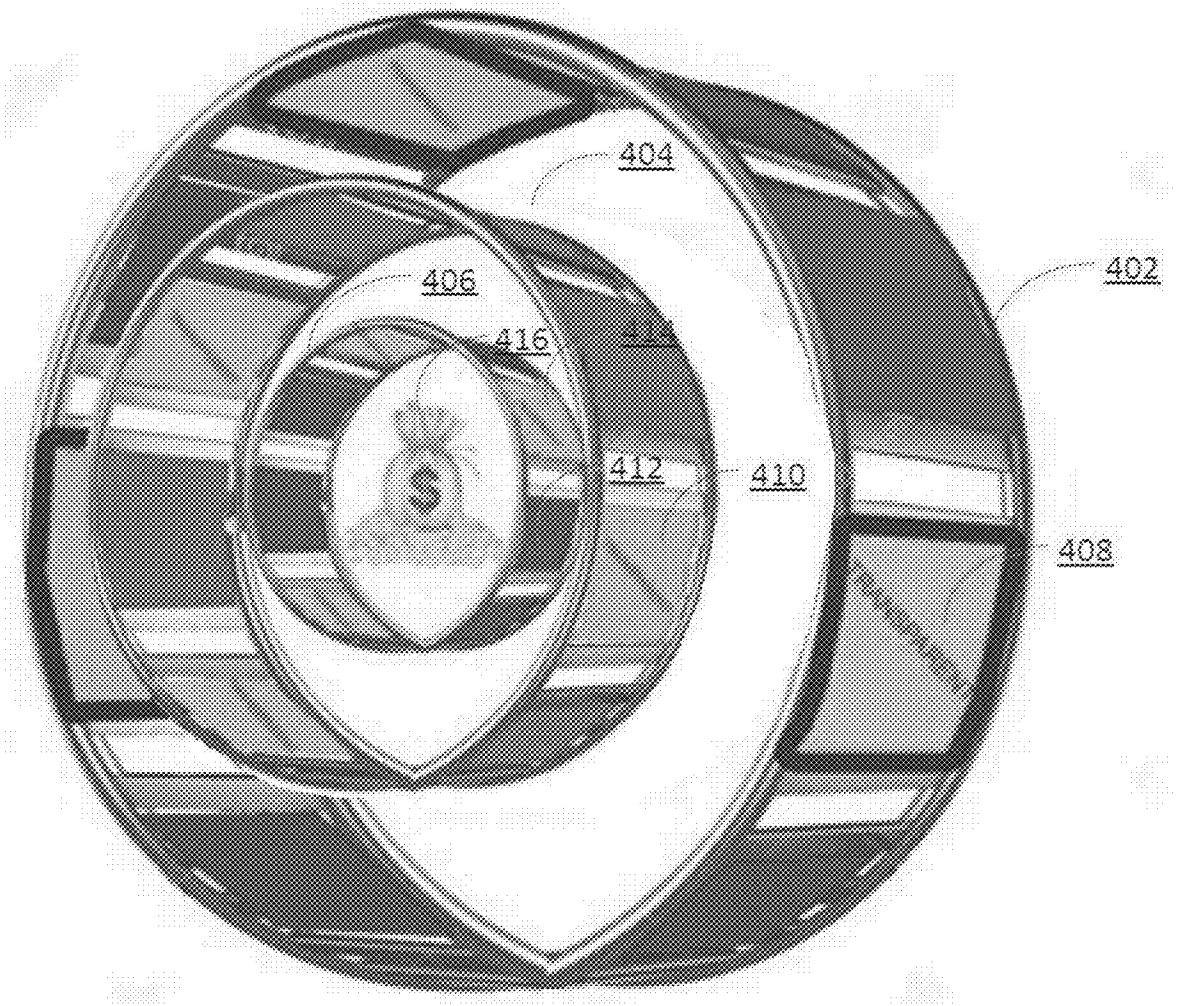
FIG. 6 shows another example of a layered three dimensional enhancement to a game according to some embodiments.

In another embodiment of the invention as shown in FIG. 6, the reels 402, 404, 406 can be positioned in such a way so that two or more reels may have different centers of gravity (i.e., one or more of the reels are in an asymmetrical arrangement). For example, the outermost reel 402 may have a centre of gravity that is placed some distance away from the centre of gravity of the middle reel 404 or innermost reel 406. This may be caused by the middle reel 404 being in closer proximity to one side of the outermost reel 402 than to the opposite side of the reel 402, as shown in FIG. 6. In this instance, while the centre of gravity for the middle reel 404 and the innermost reel 406 are still on or around the prize symbol 416, the centre of gravity for the outermost reel 402 appears to be to the right of the prize symbol 416. In yet another embodiment of the invention (not shown), the reels 402, 404 and 406 may be of a non-circular shape. For example, one or more of the reels may be of a rectangular or triangular shape. In another example, the reels may each take a different shape of form, or morph (while spinning) into a different shape of form during the game.

It is to be appreciated that the center of gravity may also overlap with the centroid or geometric center if the associated reel or game component has a uniform density.

As shown in FIGS. 4 and 6, the outer reel 402 may include a layered segment with a trigger gaming component. When the trigger gaming component is displayed in a stop line or otherwise landed on, it will trigger the next inner reel 404 to spin, for example. Other actions may also be triggered. The next inner reel 404 may also have a trigger gaming component, which will in turn trigger the other inner reel 406 to spin, and so on. Although three reels 402, 404, 406 are shown there may be more or less reels layered to provide layered segments.

A layered segment may provide access to one or more gaming components of an inner reel to award a prize. For example, an inner reel gaming component may be associated with a gaming symbol or prize that may be accessed via a trigger gaming component of an outer reel.

A layered segment may integrate one or more gaming components of an inner reel with gaming components of another reel to form a winning combination. For example, the inner reels 404, 406 may include one or more gaming components that may be integrated with gaming components of the outer reel 402 to calculate or otherwise determine winning combinations.

In the example shown in FIG. 4, a trigger gaming component of the outer reel 402 may be a transparent gaming component 408. The transparent gaming component 408 may act as a "hole" or "entrance" that permits access to an inner reel 404 spin event(s).

When the transparent gaming component 408 is landed on, it may act as a trigger or trigger component to the next 'inner' reel 404. The player may initiate a spin of the inner reel 404. The inner reel 404 may also include another transparent gaming component 410. When the transparent gaming component 410 is in the stop position, it may act as a trigger to the next inner reel 406, and so on. A center area may hold a large prize 416 such as a progressive component. The inner reel 406 may include a transparent gaming component 414 or other trigger gaming component that may trigger the prize symbol 416. The reels 402, 404, 406 may then be held as anticipation to a larger prize rather than just spinning reels.

Figure 5:
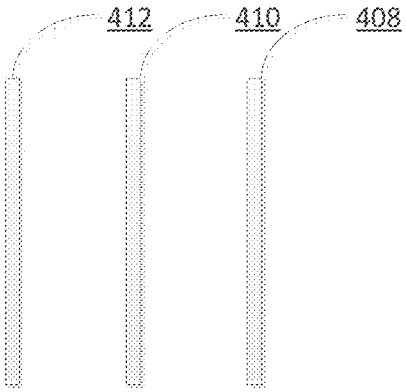
FIG. 5 is an exemplary layered segment may include three gaming components according to some embodiments.

For this example, as shown in FIG. 5, a layered segment may include three gaming components 408, 410, 412 from each of the three reels 402, 404, 406.

An innermost or inner reel 406 gaming component 412 may be associated with a prize value. The prize value may be awarded to a player when the spinning reel 412 stops on the gaming component 412. The inner reel 406 gaming component 412 may be accessed by the trigger gaming components 408, 410 of the outer reels 402, 404. Each gaming component on the different reels 402, 404, 406 may be associated with prize values that may increase in value as the inner reels are accessed. For example, a layered segment may be three gaming components 408, 410, 412, from which two are trigger gaming components 408, 410 that can be used to access the gaming component 412 of inner reel 406, and to access a prize value associated therewith. The inner reel 406 may also have a trigger gaming component 414 to access a prize jackpot 416.

In another example, an inner reel 406 gaming component 412 may be combined with gaming components 410, 412 from the outer reels 402, 404 to calculate or otherwise determine winning combinations. Accordingly, a layered segment may be a combination of gaming components 408, 410, 412 from different reels that may combine to form winning combinations.

In another embodiment of the invention, each of the reels 402, 404 and 406 may be rotating or spinning at a similar or different speed(s) during operation. In addition, while rotating, each of the reels 402, 404, and 406 may be moving from one position to a next position, and thus shifting its respective centre of gravity accordingly. For example, a game starting in the position or arrangement as shown in FIG. 4 may, during a player's engagement and operation, move to a new position or arrangement as shown in FIG. 6. This may be caused by reels 404 and 406 spinning towards the left side of the outermost reel 402, and/or by reel 402 spinning to the right side during the game. In another embodiment, some or all of three reels 402, 404 and 406 as well as the prize symbol 416 may be spinning or moving during the same time, but may be along different directions and different speed(s). As such, once the reels and other game components stop spinning, all three reels may each have a different centre of gravity. Regardless of the respective position or arrangement of each reel, a combination of gaming components 408, 410, 412 from different reels may combine or align to form winning combinations.

In one embodiment of the invention, certain game components can be caused by the display device 12, 14 to light up on the user display when a winning combination, a payline or a trigger is activated or triggered. For example, rear reel symbols or game components may light up when a payline or a trigger is activated. For another example, one or more game components in a winning combination may light up when a winning combination is "hit" or determined.

Figure 7:
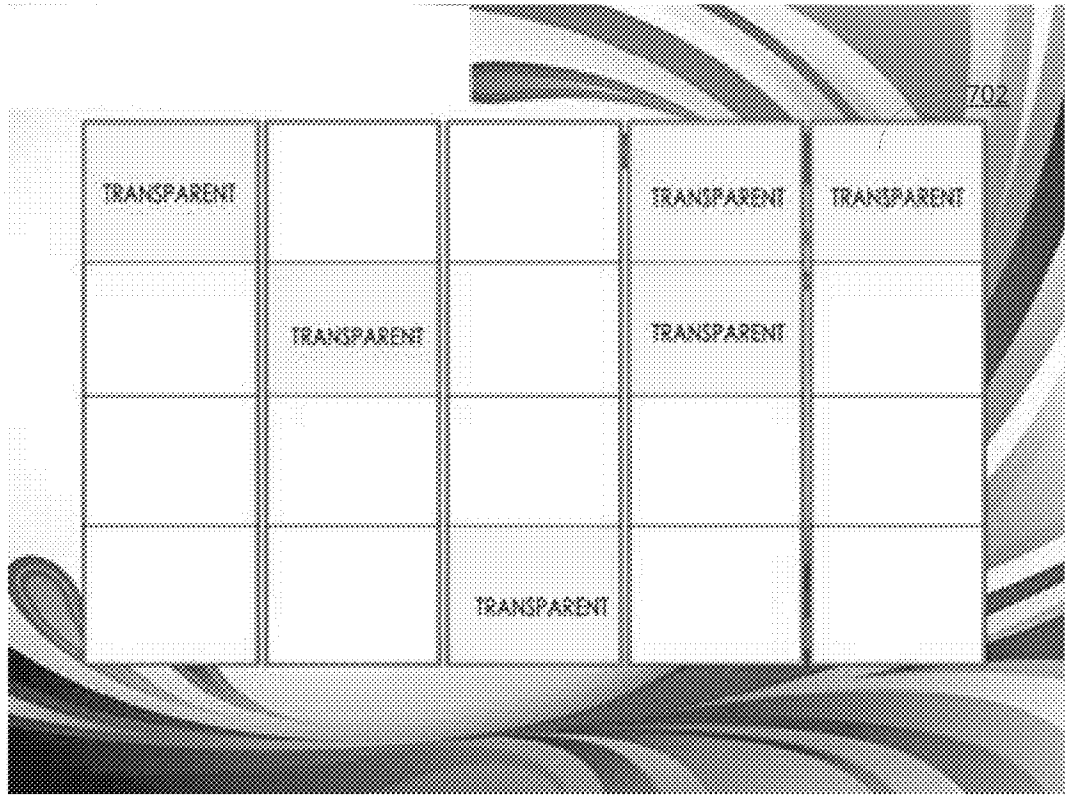
FIG. 7 shows another example of trigger game components according to some embodiments.

Referring now to FIG. 7, there is shown another example of trigger game components. In some example embodiments, the matrices may be stacked to provide a stack of game components. A trigger game component from a first matrix may trigger use of a game component from a second matrix. The trigger game component of the first matrix may be a transparent area such that an additional game component of the second matrix is visible through the transparent area for integration into a given game.

For example, the first matrix may be a grid 700 of five columns and four rows, resulting in 5×4=20 gaming components, illustrated as blank cells that may or may not be transparent. In the grid 700, an original symbol (not shown) may be associated with each one of the 20 gaming components in each blank cell.

There may be transparent symbol(s) 702 that randomly appears on the reels of the matrix. When activated (e.g. at a stop line), the transparent symbol may allow symbols in a matrix stacked behind the front grid 700 to push through and be used as part of a winning combination. This may be an action event example. If the symbols in the matrix stacked behind are used in a winning combination they may disappear (cascade, move, animate), allowing for additional symbols to push through. This may also be an action event example.

In one exemplary embodiment, the configuration of FIG. 7 may be a spinning reel game. A win may be obtained whenever matching symbols are aligned vertically, horizontally, or diagonally. These are illustrative examples and there may be other patterns of winning combinations of symbols. Using the transparent symbol(s) 702, a symbol in a matrix behind may be revealed and matched with neighboring symbols to form a winning combination, thus increasing the odds of winning. In another exemplary embodiment, the configuration of FIG. 7 may be a bingo card. Similarly, anyone of the symbols provided in cells (including a symbol stacked behind a transparent symbol(s) 702) may be used to form a complete row or column and result in a winning combination, thus increasing the odds of winning. Other possibilities for the matrix-type gaming enhancement may be used for various embodiments.

Figure 8:
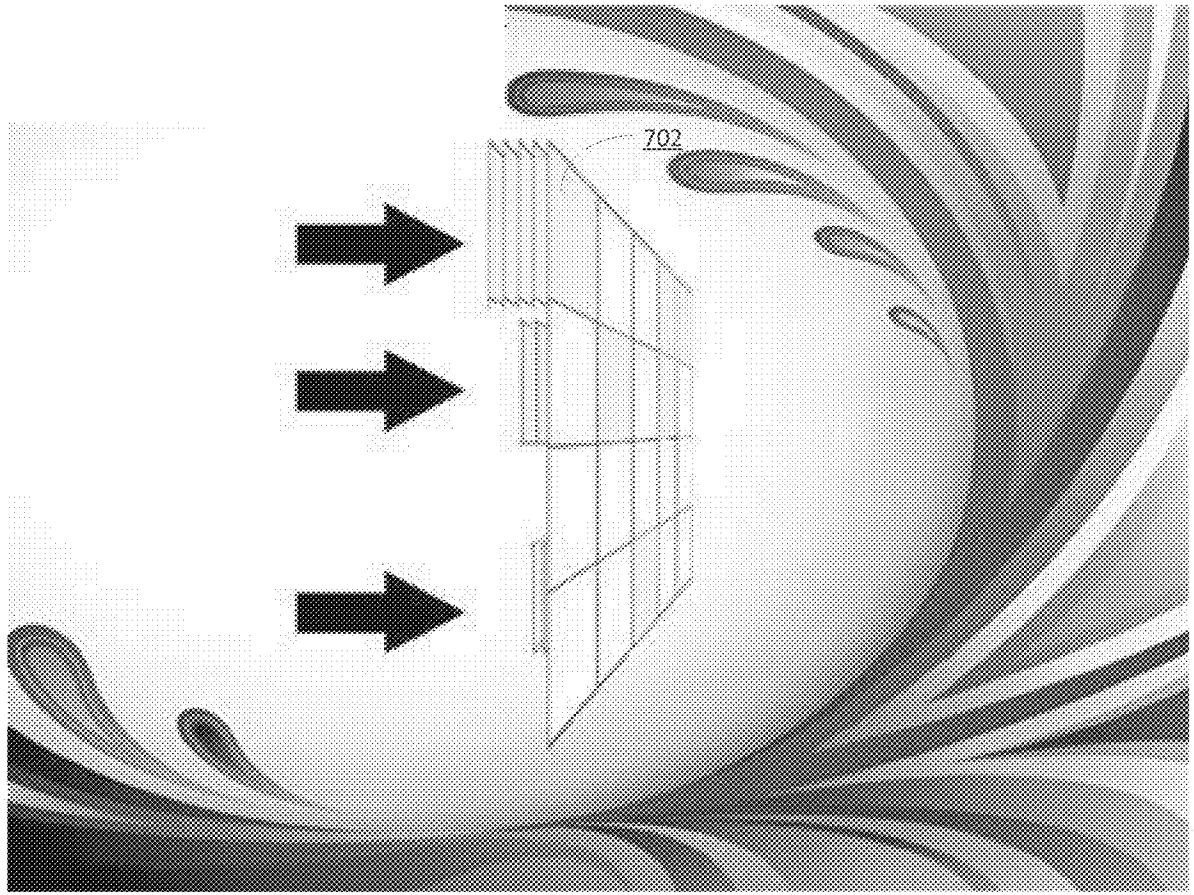
FIG. 8 shows another example of trigger game components according to some embodiments.

FIG. 8 illustrates transparent symbol(s) 702 with one or more additional matrices of gaming component stacked behind. When reel stops on transparent symbol(s) 702 then the symbols of the matrix behind may be used in line wins. The symbol spot may be replenished by a reel strip (e.g. matrix) that is housed in behind the reels (e.g. matrix). The new symbols may push or be revealed through the transparent area and become the relevant symbol visible to users and/or used in line wins.

In this scenario, various embodiments are possible to integrate the additional symbols provided on cells of the additional matrices into the original game. For example, in a spinning reel game, anyone of the additional symbols may be used to form a winning combination with neighboring cells. Alternatively, only the top, or visible, symbol may be matched with neighboring cells and as the game progresses, hidden symbols may be discovered and used to further advance the game. In another embodiment, various events in the game, such as a particular winning combination or reaching a threshold of points, may allow the player to see and/or use the additional hidden symbols in addition to the top or visible symbol to form winning combinations. Other scenarios are also possible. In addition, the number of stacked symbols may be more or less than three, as desired.

Figure 9:
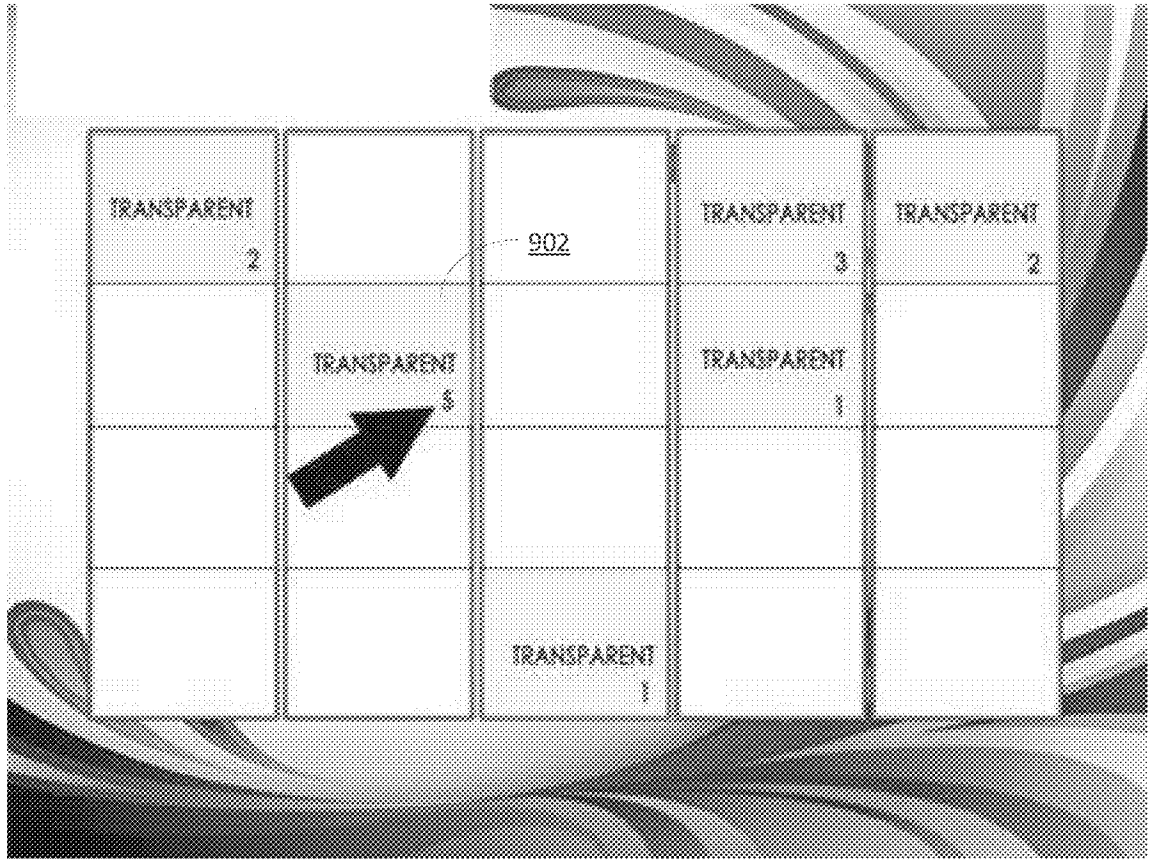
FIG. 9 shows another example of trigger game components according to some embodiments.

Referring now to FIG. 9, there is shown another example embodiment with transparent game components. A transparent game component 902 may randomly appear on the reel (e.g. first matrix). When it appears, the transparent game component 902 may include a mark within the symbol area with a number or watermark sign.

In one example, at the end of the bonus, one last free game may be awarded where all the transparent symbol areas may be activated and will allow for a set of reels in behind the first matrix game area to become active. Where there are wins, winning symbols may disappear and allow for new symbols to push through. If the newly pushed through symbols are used in a win they may disappear (cascade) allowing for additional symbols to push through. This may continue until all of the transparent numbers are used up per symbol area.

A transparent game component 902 may form part of the reel grid as part of the game. When a 'transparent' symbol 902 lands, it may mark the game grid (5×4 area) where it lands with a number or watermark. The total number of transparent symbols that has landed per area may be tracked. The watermark may indicate the number of additional matrices or game components of matrices behind the original or top layer matrix. For example, there may be five matrixes behind the top layer matrix as represented by the number 5 on the transparent game component 902. Each additional matrix may be of a different size or configuration, so not all transparent game components will have the same number or watermark, as each matrix may not cover the space behind all transparent game components.

Figure 10:
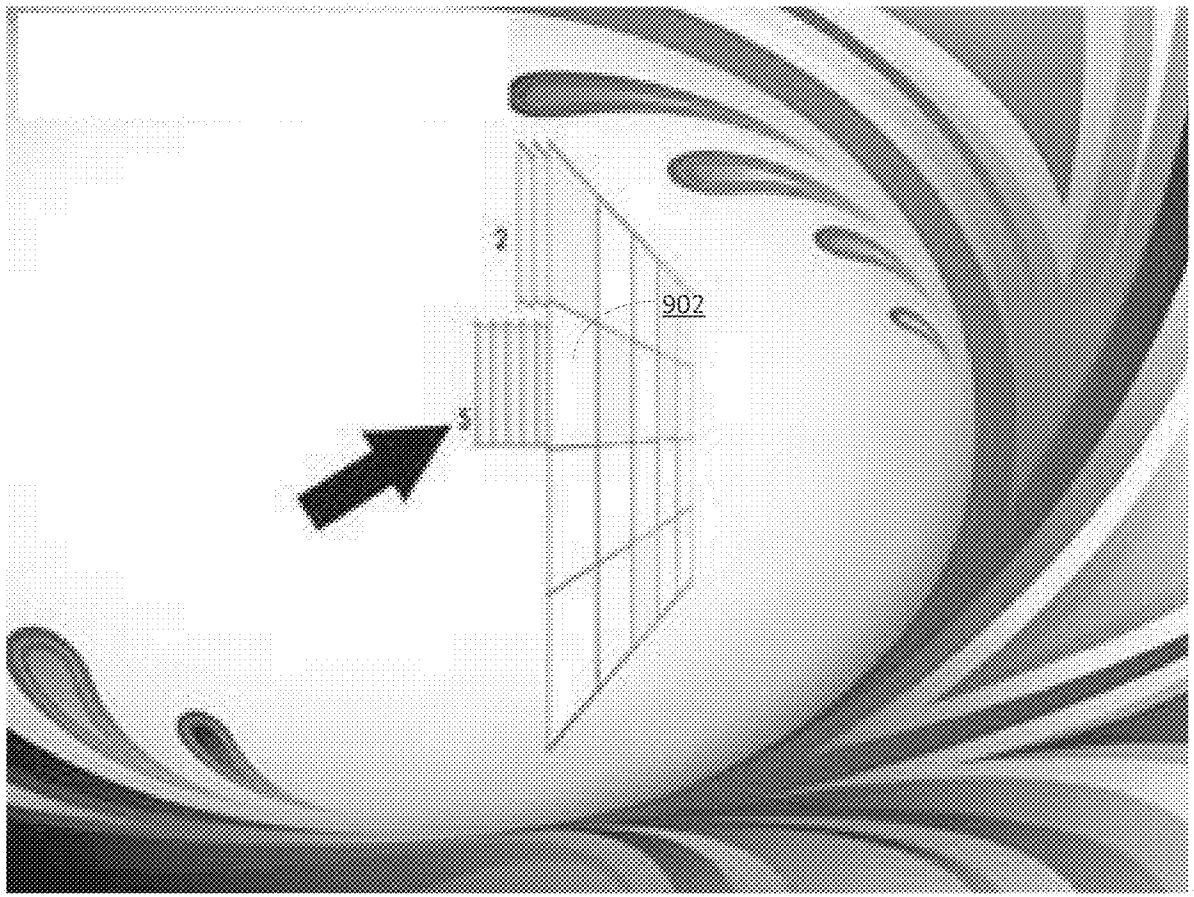
FIG. 10 shows another example of trigger game components according to some embodiments.

Referring to FIG. 10, there is shown 5 additional game components from five additional matrices stacked behind the transparent game component 902.

In some example embodiments, when the free games are complete, one final free game may be awarded and the transparent symbol areas may become activated with the 'push through' symbols. These can be wilds, bonus triggers, straight credit prizes, jackpot symbols, scatters, multipliers, etc. symbols. For example, the deeper or more layers the user gets, the more valuable the game components can become.

Referring again to FIG. 4 there is shown an example trigger game component that is transparent to reveal additional game components.

In accordance with some embodiments, display device 12, 14 may include transparent game components on reels to reveal the back side of the reel as it spins, allowing the player to track special symbols as they travel around the dark side of the reel, and around again into view.

In accordance with some embodiments, a game component on a matrix layered behind a top matrix (or embedded therein) may have a three-dimensional structure. Instead of a reel spin, the action event may be a rotation of the three-dimensional structure to reveal a game symbol. That is, a game component on a matrix may be a multi-facet gaming component. Additional symbols may be provided on one or more of the facets of the three-dimensional structure. The additional symbols may be used in various ways. For example, in a spinning reel game, as each game component is spun in a single direction, such as about the x axis, the multi-facet gaming component may be spun about multiple axes, such as the y axis and/or the x axis, thus resulting in more possibilities for the spinning gaming component. Alternatively, various events in the game, such as a particular winning combination or reaching a threshold of points, may activate the trigger symbol and allow the player to freely rotate the multi-faceted gaming component in a desired direction, such that the symbol on the facet that is rotated to the front may be used for a winning combination. The symbols on the facets other than the front may be displayed to the player or hidden from view. Various events in the game may allow hidden facets to be selectively shown to the player. Other scenarios are also possible. While the multi-faceted three-dimensional structure in this example can be a cube, other geometrical shapes are also possible, such as a cylinder, an octagon, and many others.

In accordance with embodiments described herein, a game component may be an enhanced three-dimensional multi-faceted game component. The multi-faceted game components may be arranged in a three-dimensional configuration. Each multi-faceted game component may be associated with a gaming symbol. The gaming symbol may be identifiable, visible and displayed on multiple faces of each multi-faceted game component. When the multi-faceted game components are arranged in a three-dimensional configuration one or more of the faces may be covered by other game components or hidden from a particular view or angle, while one or more of the faces may still be visible at the particular view or angle. The game symbol for each multi-faceted game component may still be identifiable as it may still be shown on the visible face(s). Three-dimensional enhancements may involve rotations of multi-faceted game components and gaming surfaces on multiple axes rotation.

The embodiments described herein are implemented by physical computer hardware embodiments. The embodiments described herein provide useful physical machines and particularly configured computer hardware arrangements of computing devices, servers, electronic gaming terminals, processors, memory, networks, for example. The embodiments described herein, for example, is directed to computer apparatuses, and methods implemented by computers through the processing of electronic data signals.

The embodiments described herein involve computing devices, servers, electronic gaming terminals, receivers, transmitters, processors, memory, display, networks particularly configured to implement various acts. The embodiments described herein are directed to electronic machines adapted for processing and transforming electromagnetic signals which represent various types of information. The embodiments described herein pervasively and integrally relate to machines, and their uses; and the embodiments described herein have no meaning or practical applicability outside their use with computer hardware, machines, a various hardware components.

Substituting the computing devices, servers, electronic gaming terminals, receivers, transmitters, processors, memory, display, networks particularly configured to implement various acts for non-physical hardware, using mental steps for example, may substantially affect the way the embodiments work.

Such computer hardware limitations are clearly essential elements of the embodiments described herein, and they cannot be omitted or substituted for mental means without having a material effect on the operation and structure of the embodiments described herein. The computer hardware is essential to the embodiments described herein and is not merely used to perform steps expeditiously and in an efficient manner.

While illustrated in the block diagrams as groups of discrete components communicating with each other via distinct electrical data signal connections, the present embodiments are provided by a combination of hardware and software components, with some components being implemented by a given function or operation of a hardware or software system, and many of the data paths illustrated being implemented by data communication within a computer application or operating system. The structure illustrated is thus provided for efficiency of teaching example embodiments. The hardware components are configured to provide practical applications of innovative computerized gaming features. The hardware components are configured to provide physical transformations by, for example, transforming the display on gaming screen with three dimensional enhancements.

The concept of enhanced game components may be applied to game mechanics in multiple ways. For example, Wild cards or wilds may be placed one on top of each other to create a depth showing multiple wilds in one spot resulting in awarding of the same line multiple times. Wilds may have a multiplier attached to each of the layers in the depth of the set of reels, for example, the front one is worth 1×, the second level is worth 2×, the third level is worth 3×, etc. Surrounding Wilds may be used by offering a layer above a regular reel set that would allow for wilds to be created when reels stop (i.e. any symbol landing would have the opportunity to become wild). This allows for depth to the surrounding wilds. For games that may have a match functionality, it would allow for chunks of wilds and symbols to pay. In some embodiments, wilds may stay in place until it is awarded. This would allow for the wild to grow in size allowing for either: multiplier attached to the wild; additional wilds stacking up and growing on the spot; or physically growing outwards on the Z axis onscreen.

In addition, in one embodiment of the invention, wild cards can be transferred from one game component to another game component within the same reel or matrix, or from a game component in a reel (or matrix) to a different game component in another reel (or matrix). This transferring of wild cards may happen in one or more spins of the one or more reels.

In another embodiment, a whole rear reel can become a single symbol such as in the case of an expanding wild card.

Scatters may be used in a stacked configuration as well. Scatters may be placed on top of each other to create a depth showing multiple scatters in one spot, resulting in an award for a collective number of scatters. Scatters may also have a multiplier attached to each of the layers in the depth, for example, the front one is worth 1×, the second level is worth 2×, the third level is worth 3×, etc.

The third dimension provided by the enhanced game components may act as a portal or hole into the game (e.g. base game, secondary game, bonus game), given access to a bonus round or an additional win category. Symbols may appear with multiple layers and players may collect symbols and place them one on top of another in a single space. Three-dimensional stacks may be formed by allowing for symbols to be stacked not just on the vertical but also in the third (z) axis, allowing for depth to the normally viewed stacked symbol.

The game component enhancements allow for chunks of symbols that are spanning the vertical space of the reel to also have a back expansion area that causes a 'block' effect. It allows for chunks of symbols that are spanning the horizontal space of the reel to also have a back expansion area that causes a 'block' effect. It may also allow for depth on certain reels to create a new pattern of the physical game grid dimension.

Triggers may be modified using the game component enhancements. Such triggers may include, for example, consecutive triggers (on or outside of a reel), scatter, and trigger tiles. Triggers may lead to various events, such as additional credits, additional payouts, secondary games, bonus rounds, etc. Trigger tiles may be placed on any reel shape/dimension as desired, as a triggering mechanism. Multiple layers could be applied to this triggering mechanism as well. Pay ways may also be modified, as the enhancements allow for multiple games to be played in the same space. Shapes of lines wins may be collected to create a full screen pattern of extra prizes. Different layers with different line sets may be played all at once.

The game enhancements may be applied to multiple environments, such as Keno, 3D game grids, Player User Interfaces (PUI), Greenball (as described in U.S. application Ser. No. 13/631,129, the contents of which are hereby incorporated by reference), and many others. For Keno, multiple balls may be placed on a same number. One screen may be provided with layered effects. For 3D game grids, a 'cube' effect may be created, where the player can interact with the cube to 'spin' it to reveal an additional bonus prize. The enhancement offers a position to expand outwards to create a multiple symbol container. It also offers multi-levels, different matrices, games that become available during bonus rounds as special features activate the exterior, or multiple games to be wagered upon. Multi-facet game boards (i.e. with a matrix on different angles) are also possible.

Bonus types may also be enhanced via the game component enhancements. For example, multiple free games may be played in a layered style. This allows for symbols that land one in front of another that match to create some sort of super win/super symbol that spans in depth and possibly in height, if synchronized reels are used. In a picking screen for picking a prize, the player may grab and drag the 3D object and reposition it on the screen. Progressive posts may get physically larger and expand outwards to show the player that they are getting closer to being awarded, and/or larger in value.

The user interfaces, computer implemented methods, and computer system components described may be used in connection with a variety of different games that are pattern games or that include pattern game components.

Various functions or features described in this disclosure may be implemented as part of different gaming systems. For example:

(A) The winning enhancements may be implemented as part of a game to system (G2S) system.

(B) As previously stated, the user interfaces, computer implemented methods, and computer system components described herein may be used by an EGM.

(C) In the event the game is a lottery game, the game computer may be an in-store gaming system or a gaming kiosk. For lottery games including the enhancements to the game components, the host system may be controlled by a government agency.

As described herein, a third dimension may be provided by the enhanced game components. Three dimensional enhancements may be provided as a primary game (or base game), secondary game or a bonus game in some embodiments. Motion tracking data for the player received via camera may be used to update and modify the three dimensional enhancements, for example. Head and body movements of the player may control aspects of the game.

In some example embodiments, the number of bonus choices may be proportional to the size of the bet, or average bet. The number of features may also be proportional to the size of the bet, or average bet.

Three dimensional enhancements may be provided as dynamic content, where bonus selection and other gaming features may display differently from one trigger to the next. The three dimensional enhancements provide variety in primary and bonus game types to appeal to a broad player demographic.

A bonus game may include progressive levels and may be of a different game type than the primary game, including new symbols and rules. There may also be hidden features within the game.

The game may be a tile based game where different lines shapes of corresponding tiles may be associated with different winning amounts for the game.

Three dimensional enhancements may be used for various game features. For example, there may be a three dimensional enhancement for a trigger symbol, a base game, a tension spin, a large or medium win, a bonus game, a bonus game choice entry, help functionality, introduction to game, and so on.

An example flow for a game with three dimensional enhancements may include a base game with bonus or hidden features. There may be a trigger within the base game to launch a bonus selection game level where the player can select a bonus game from multiple choices. There may be a short description for each bonus game. The amount of bet or average bet within the base game may be proportional to the number of bonus game choices. For example, a higher bet may increase the number of bonus games to select from. The bonus games may be different types of games. The base game may also be a different type of game.

The game may be played on a standalone video gaming machine, a gaming console, on a general purpose computer connected to the Internet, on a smart phone, or using any other type of gaming device. The video gaming system may include multiplayer gaming features.

The game may be played on a social media platform, such as Facebook™. The video gaming computer system may also connect to a one or more social media platforms, for example to include social features. For example, the video gaming computer system may enable the posting of results as part of social feeds (e.g. posting to Twitter™). In some applications, no monetary award is granted for wins, such as in some on-line games. For playing on social media platforms, non-monetary credits may be used for bets and an award may comprise similar non-monetary credits that can be used for further play or to have access to bonus features of a game. All processing may be performed remotely, such as by a server, while a player interface (computer, smart phone, etc.) displays the game interface to the player.

The functionality described herein may also be accessed as an Internet service, for example by accessing the functions or features described from any manner of computer device, by the computer device accessing a server computer, a server farm or cloud service configured to implement said functions or features.

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. A processor may be implemented using circuitry in any suitable format.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including an EGM, A Web TV, a Personal Digital Assistant (PDA), a smart phone, a tablet or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards and pointing devices, such as mice, touch pads, and digitizing tablets. As another example, a computer may receive input information through speech recognition or in other audible formats.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the enhancements to game components may be embodied as a tangible, non-transitory computer readable storage medium (or multiple computer readable storage media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other non-transitory, tangible computer-readable storage media) encoded with one or more programs that, when executed on one or more computers or other processors, perform methods that implement the various embodiments discussed above. The computer readable medium or media can be transportable, such that the program or programs stored thereon can be loaded onto one or more different computers or other processors to implement various aspects as discussed above. As used herein, the term "non-transitory computer-readable storage medium" encompasses only a computer-readable medium that can be considered to be a manufacture (i.e., article of manufacture) or a machine.

The terms "program" or "software" are used herein in a generic sense to refer to any type of computer code or set of computer-executable instructions that can be employed to program a computer or other processor to implement various aspects of the present invention as discussed above. Additionally, it should be appreciated that according to one aspect of this embodiment, one or more computer programs that when executed perform methods as described herein need not reside on a single computer or processor, but may be distributed in a modular fashion amongst a number of different computers or processors to implement various aspects.

Computer-executable instructions may be in many forms, such as program modules, executed by one or more computers or other devices. Generally, program modules include routines, programs, objects, components, data structures, etc, that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Various aspects of the present game enhancements may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments. While particular embodiments have been shown and described, changes and modifications may be made.

The invention claimed is:

1. An electronic gaming machine for providing three dimensional enhancements to game components comprising:

at least one processor;

at least one persistent data store;

at least one receiver to receive game data for storage in the at least one persistent data store;

a plurality of input devices including:

a) an acceptor of a physical item associated with a monetary value;

b) a validator configured to identify the physical item and to cause the monetary value associated with the physical item to be added to a credit balance in the electronic gaming machine; and c) a cashout button actuatable to cause an initiation of a payout associated with the credit balance; and a display device configured with a user interface to display a portion of the game data as a first matrix of at least one of a row and a column of game components in accordance with a set of game rules for a given game, each one of the game components of the first matrix having an original symbol associated thereto, and at least a second matrix of at least one of a row and a column of game components in accordance with the set of game rules for the given game, each one of the game components of the second matrix having an original symbol associated thereto;

wherein the first matrix is rendered as a first reel, and the second matrix is rendered as a second reel embedded within the first reel, wherein the first reel is layered on top of the second reel in a 3D configuration and the game components of the second reel are initially hidden by the first reel;

wherein the processor is configured to:

initiate an instance of the given game in response to user input when the credit balance has at least a predetermined level;

identify at least one game component of the first matrix as a trigger game component;

detect activation of the trigger game component, wherein the trigger game component is a transparent game component that reveals at least one of the game components of the second matrix and wherein activation of the trigger game component occurs when the transparent game component stops in a pay line of the display device;

trigger an action event associated with the second matrix, wherein the action event comprises a spin of the second reel;

integrate the at least one revealed game component of the second matrix into the given game;

determine a winning outcome using the first matrix and the second matrix; and in response to determining the winning outcome, apply an award associated with the winning outcome to the credit balance.

2. The electronic gaming machine of claim 1, wherein the at least one game component of the second matrix lights up on the user interface when integrated into the given game.

3. The electronic gaming machine of claim 1, wherein:

the display device is further configured to display a portion of the game data as a third matrix of at least one of a row and a column of game components in accordance with the set of game rules for the given game, each one of the game components having an original symbol associated thereto; and the processor is further configured to:

identify at least one game component of the second matrix as a second trigger game component;

detect activation of the second trigger game component;

trigger an action event associated with the third matrix;

integrate at least one game component of the third matrix into the given game; and determine a winning outcome using the first matrix, the second matrix, and the third matrix;

and wherein the second matrix is layered on top of the third matrix.

4. The electronic gaming machine of claim 3, wherein the third matrix is a third reel embedded within the second reel.

5. The electronic gaming machine of claim 3, wherein the at least one game component of the third matrix triggers a progressive jackpot or a bonus game prize used for the winning outcome.

6. The electronic gaming machine of claim 1, wherein the first reel and the second reel are arranged asymmetrically such that the first reel and the second reel each has a different center of gravity on the user display.

7. The electronic gaming machine of claim 1, wherein one or more game components are caused by the display device to light up when a winning, a payline or a trigger is activated or triggered.

8. The electronic gaming machine of claim 1, wherein at least one wild card is transferred from one game component to another game component within the same matrix, or from a game component in a matrix to a different game component in another matrix.

9. The electronic gaming machine of claim 1, wherein all the game components in a matrix constitute a single symbol that is an expanding wild card.

10. The electronic gaming machine of claim 1, wherein the at least one game component of the second matrix is associated with a prize value used for the winning outcome.

11. The electronic gaming machine of claim 1, wherein the at least one game component of the second matrix triggers a progressive jackpot prize used for the winning outcome.

12. The electronic gaming machine of claim 1, wherein the at least one game component of the second matrix triggers a secondary prize used for the winning outcome.

13. The electronic gaming machine of claim 1, wherein the at least one game component of the second matrix is associated with at least one additional symbol used for the winning outcome by forming a winning outcome with a symbol of the at least one gaming component of the first matrix.

14. The electronic gaming machine of claim 1, wherein the display device is configured with the user interface to display at least one stack of game components, wherein the at least one stack of game components comprises the trigger game component from the first matrix and the at least one game component from the second matrix.

15. An electronic gaming system for providing three dimensional enhancements to game components comprising:

a server comprising a transmitter for transmitting electronic data signals representing game data; and an electronic device comprising:

at least one processor;

at least one persistent data store;

at least one receiver to receive the electronic data signals representing game data for storage in the at least one persistent data store;

a plurality of input devices including:

a) an acceptor of a physical item associated with a monetary value;

b) a validator configured to identify the physical item and to cause the monetary value associated with the physical item to be added to a credit balance in the electronic device; and c) a cashout button actuatable to cause an initiation of a payout associated with the credit balance;

a display device configured with a user interface to display a portion of the game data as a first matrix of at least one of a row and a column of game components in accordance with a set of game rules for a given game, each one of the game components of the first matrix having an original symbol associated thereto, and at least a second matrix of at least one of a row and a column of game components in accordance with the set of game rules for the given game, each one of the game components of the second matrix having an original symbol associated thereto;

wherein the first matrix is rendered as a first reel, and the second matrix is rendered as a second reel embedded within the first reel, wherein the first reel is layered on top of the second reel in a 3D configuration and the game components of the second reel are initially hidden by the first reel;

wherein the processor is configured to:

initiate an instance of the given game in response to user input when the credit balance has at least a predetermined level;

identify at least one game component of the first matrix as a trigger game component;

detect activation of the trigger game component, wherein the trigger game component is a transparent game component that reveals at least one of the game components of the second matrix, and wherein activation of the trigger game component occurs when the transparent game component stops in a pay line of the display device;

trigger an action event associated with the second matrix, wherein the action event comprises a spin of the second reel;

integrate the at least one revealed game component of the second matrix into the given game;

determine a winning outcome using the first matrix and the second matrix; and in response to determining the winning outcome, apply an award associated with the winning outcome to the credit balance; and a network configured to provide a communication link to couple the server and the electronic device.

16. The electronic gaming system of claim 15, wherein the electronic device is an electronic gaming terminal and wherein the system further comprises:

a mobile gaming device operated by a player coupled via a communications link to the electronic gaming terminal, the mobile gaming device running a remote gaming program to play the given game, the electronic gaming terminal programmed to carry out at least the game functions of pseudo-randomly determining a game outcome and determining an award to a player, receiving player control signals by the first gaming terminal from the mobile gaming device to initiate the first game;

wherein the electronic gaming terminal is configured to carry out the game by the first gaming terminal, including determining a final outcome of the game and any award for the winning outcome and transmit electronic data signals to the mobile gaming device identifying the winning outcome of the game and the award.

17. The electronic gaming system of claim 15, wherein:

the display device is further configured to display a portion of the game data as a third matrix of at least one of a row and a column of game components in accordance with the set of game rules for the given game, each one of the game components having an original symbol associated thereto; and the processor is further configured to:

identify at least one game component of the second matrix as a second trigger game component;

detect activation of the second trigger game component;

trigger an action event associated with the third matrix;

integrate at least one game component of the third matrix into the given game; and determine a winning outcome using the first matrix, the second matrix, and the third matrix;

wherein the second matrix is layered on top of the third matrix.

18. A computer implemented method in an electronic gaming machine for providing three dimensional enhancements to game components comprising:

receiving, via at least one receiver, game data for storage in at least one persistent data store;

accepting, via an acceptor, a physical item associated with a monetary value;

identifying, via a validator, the first physical item;

adding the monetary value associated with the physical item to a credit balance in the electronic gaming machine;

initiating an instance of the given game in response to user input when the credit balance has at least a predetermined level;

displaying, using a display device, a portion of the game data as a first matrix of at least one of a row and a column of game components in accordance with a set of game rules for a given game, each one of the game components of the first matrix having an original symbol associated thereto, and at least a second matrix of at least one of a row and a column of game components in accordance with the set of game rules for the given game, each one of the game components of the second matrix having an original symbol associated thereto;

wherein the first matrix is rendered as a first reel and the second matrix is rendered as a second reel embedded within the first reel, wherein the first reel is layered on top of the second reel in a 3D configuration and the game components of the second reel are initially hidden by the first reel;

identifying, using a processor, at least one game component of the first matrix as a trigger game component;

detecting, using the processor, activation of the trigger game component, wherein the trigger game component is displayed as a transparent game component that reveals at least one of the game components of the second matrix, and wherein activation of the trigger game component occurs when the transparent game component stops in a pay line of the display device;

triggering, using the processor, an action event associated with the second matrix, wherein the action event comprises a spin of the second reel;

integrating, using the processor, at least one game component of the second matrix into the given game;

determining, using the processor, a winning outcome using the first matrix and the second matrix;

in response to determining the winning outcome, applying an award associated with the winning outcome to the credit balance; and initiating, via actuation of a cashout button, a payout associated with the credit balance.

19. The method of claim 18, wherein the action event comprises:

spinning, using the processor, the second reel.

20. The method of claim 18, further comprising:

displaying, using the display device, a portion of the game data as a third matrix of at least one of a row and a column of game components in accordance with the set of game rules for the given game, each one of the game components having an original symbol associated thereto;

identifying, using the processor, at least one game component in the second matrix as a second trigger game component;

detecting, using the processor, activation of the second trigger game component of the second matrix;

triggering, using the processor, an action event associated with the third matrix;

integrating, using the processor, the at least one game component of the third matrix into the given game; and determining, using the processor, the winning outcome using the first matrix, the second matrix, and the third matrix.

* * * * *